US008112823B2

(12) United States Patent
Dombrowski

(10) Patent No.: US 8,112,823 B2
(45) Date of Patent: Feb. 14, 2012

(54) COMBINATION GARBAGE DISPOSAL SCRAPER, SAFETY POKER AND DEODORIZER

(75) Inventor: Thomas K Dombrowski, Elk Grove Village, IL (US)

(73) Assignee: Disposal Guard Inc., Elk Grove Village, IL (US)

( * ) Notice: Subject to any disclaimer, the term of this patent is extended or adjusted under 35 U.S.C. 154(b) by 1160 days.

(21) Appl. No.: 11/870,569

(22) Filed: Oct. 11, 2007

(65) Prior Publication Data

US 2009/0094766 A1 Apr. 16, 2009

(51) Int. Cl.
*E03D 9/02* (2006.01)

(52) U.S. Cl. ..... 4/222.1; 4/294; 4/295; 241/46.016

(58) Field of Classification Search ..... 4/286–295, 4/222, 222.1, 226.1, 628, 661, 309; 241/46.013–46.016

See application file for complete search history.

(56) References Cited

U.S. PATENT DOCUMENTS

| | | | | |
|---|---|---|---|---|
| 2,020,864 | A * | 11/1935 | Aronson et al. | 4/222.1 |
| 2,723,905 | A | 11/1955 | Coakley | |
| 3,112,499 | A * | 12/1963 | Coward | 4/222 |
| 4,224,701 | A | 9/1980 | Huang | |
| 4,504,996 | A | 3/1985 | Loos | |
| 5,354,468 | A | 10/1994 | Richards | |
| 5,473,782 | A | 12/1995 | Coakley | |
| 6,866,440 | B1 | 3/2005 | Bart | |
| 7,673,364 | B2 * | 3/2010 | Dombrowski | 15/105 |
| 2006/0038047 | A1 * | 2/2006 | Anderson et al. | 241/46.013 |

* cited by examiner

*Primary Examiner* — Huyen Le
*Assistant Examiner* — Erin Deery

(57) ABSTRACT

A combination garbage disposal safety poker, scraper and deodorizer/sanitizer device is provided. The device comprises a cup-shaped strainer, a handle mounted to the strainer, a hollow cylindrical stem extending downward from the strainer, and a replaceable rubber scraper connected to lower end of the hollow stem and used for scraping waste from dishes and sinks. The inside of the stem serves as a compartment for holding a deodorizer/sanitizer tablet. Holes in the strainer and in the stem expose the deodorizer/sanitizer tablet to water, thereby gradually dissolving the tablet and continually deodorizing the garbage disposal unit and drain.

4 Claims, 2 Drawing Sheets

COMBINATION GARBAGE DISPOSAL SCRAPER, SAFETY POKER AND DEODORIZER

BACKGROUND

1. Field of the Invention

This patent relates to a combination garbage disposal scraper, safety poker and deodorizer/sanitizer.

2. Description of the Related Art

Combination garbage disposal pokers and scrapers are known in the art. For example, each of U.S. Pat. Nos. 4,395,792; Des. 269, 302; Re. 32,141 and 5,488,749 discloses a combination poker and scraper for use with garbage disposals. Also known are various means for deodorizing and/or sanitizing a sink or garbage disposal, including those disclosed in U.S. Pat. Nos. 3,112,499; 5,354,468 and 6,866,440. However, no reference known to the inventor teaches a utensil that can be used as a scraper for scraping food debris into a garbage disposal drain, a plunger or poker for tamping the food debris past the safety guard and into the disposal, and a deodorizer/sanitizer for keeping the drain and garbage disposal deodorized and sanitized.

Thus it is an object of the present invention to provide a utensil that combines a scraper with a garbage disposal plunger and deodorizer/sanitizer.

It is also an object of the present invention to provide a utensil having interchangeable handles and strainers and a detachable scraper that can be replaced.

Further and additional objects will appear from the description, accompanying drawings, and appended claims.

SUMMARY OF THE INVENTION

The present invention is a combination garbage disposal poker, scraper and deodorizer/sanitizer device to be used with a sink drain mounted garbage disposal unit. The device comprises a scraper attached to the lower end of a hollow tubular stem defining a deodorizer compartment that can hold a deodorizer/sanitizer tablet. A drain member, such as a strainer or sink stopper, may be mounted to the upper end of the stem.

The strainer is generally cup-shaped and comprises a bottom wall and a cylindrical side wall extending upward from the bottom wall. Water drainage holes disposed in the bottom wall communicate with the deodorizer compartment, thereby exposing a deodorizer/sanitizer tablet held within the compartment to water. The strainer also comprises a handle attached to the strainer bottom wall, preferably by screw threads. The handle can be separated from the strainer bottom wall to expose a relatively larger hole in the strainer bottom wall that communicates with the deodorizer compartment. When the handle is removed a deodorizer/sanitizer tablet can be introduced into the deodorizer compartment.

The hollow stem comprises a cylindrical wall that includes openings through which water can pass into and out of the deodorizer compartment. The device further comprises a connector for attaching the scraper to the hollow stem. The connector comprises a body and a horizontal upper wall that serves as a bottom wall of the compartment when the connector is attached to the stem.

THE DRAWINGS

DETAILED DESCRIPTION OF THE INVENTION

Figure 1:
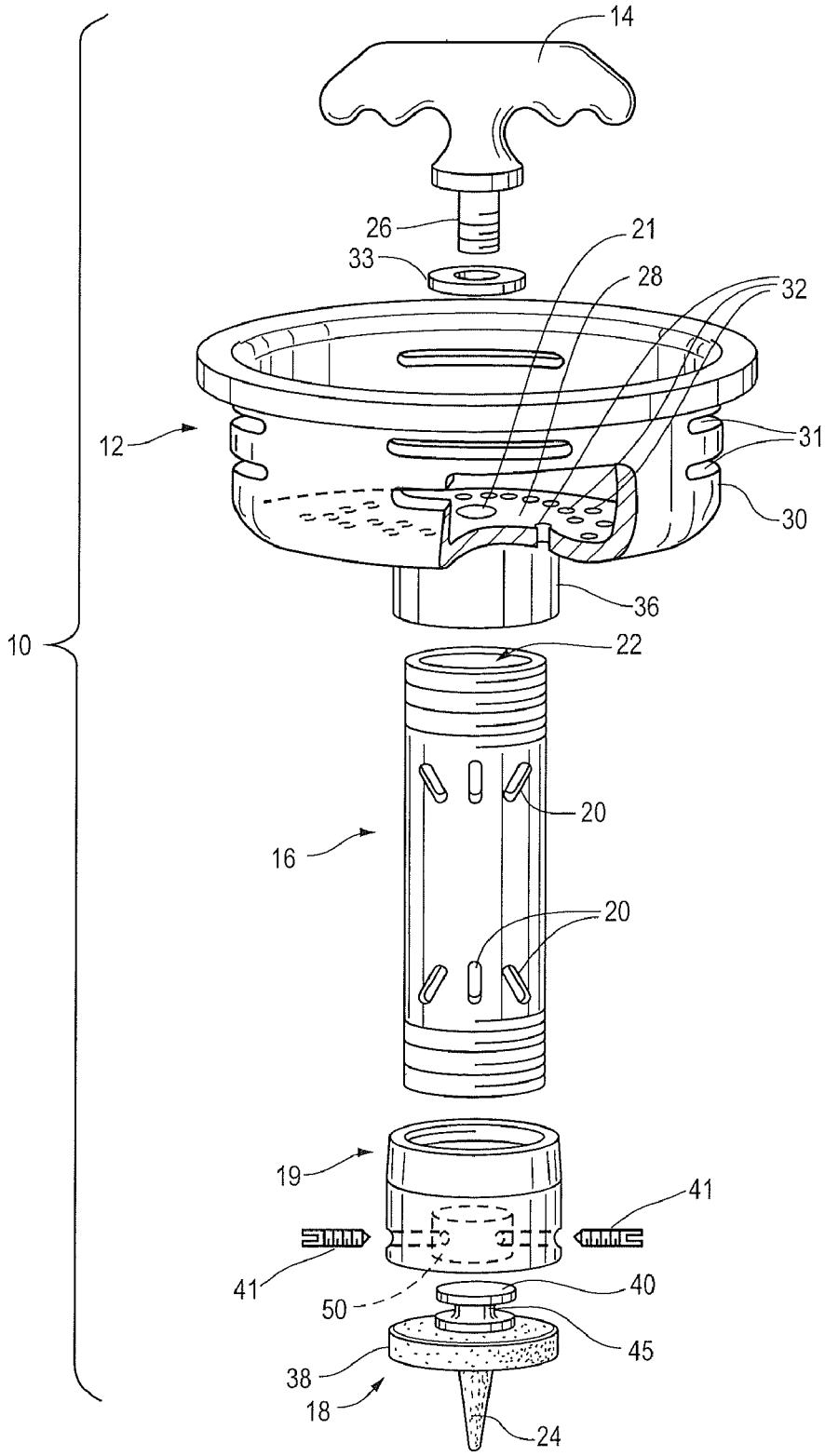
FIG. 1 is an exploded view of the present invention, a combination scraper, plunger and deodorizer/sanitizer device for use with garbage disposals.

While this invention may be embodied in many forms, there is shown in the drawings and will herein be described in detail one or more embodiments, with the understanding that this disclosure is to be considered an exemplification of the principles of the invention and is not intended to limit the invention to the illustrated embodiments.

Turning to the drawings, there is shown in FIG. 1 one embodiment of the present invention, a combination garbage disposal safety poker, scraper and deodorizer/sanitizer device 10. The device 10 comprises a drain member 12 for suspending the device 10 within a garbage disposal drain, a handle 14 attached to a drain member 12, a hollow cylindrical stem 16 extending downward from and attached to the drain member 12, and a replaceable rubber scraper/poker 18 connected to the lower end of the hollow stem 16 by a connector 19.

The drain member 12 can be a strainer as shown in the figures, a stopper, or a combination strainer and stopper. The strainer shown in the figures is cup-shaped and comprises a bottom wall 28 and a cylindrical side wall 30 extending upward from the bottom wall 28. The bottom wall includes water drainage holes 32, some of which may communicate with the hollow interior 22 of the stem 16, while others, closer to the strainer side wall 30, communicate directly with the space within garbage disposal unit G. Optional elongated openings 31 in the strainer side wall 30 allow additional water drainage into the garbage disposal unit G.

The drain member 12 also comprises a female screw mount base 36 extending downward from the strainer bottom wall 28. The base 36 receives the stem 16 by means of a threaded connection.

Alternatively, a stopper (not shown) may be mounted to the upper end of the hollow stem 16. The stopper can be any shape, including but not limited to dome shaped, and may or may not have holes through which water can pass.

The handle 14 is connected to the drain member 12 by a screw mount 26 and can be removed to expose a hole 21 located in the bottom wall 28 of the drain member 12. The hole 21 communicates with the hollow interior 22 of the stem 16 so that a deodorizer/sanitizer tablet 23 (FIG. 2) can be added to the interior compartment 22 by dropping it through the hole 21. A washer 33 may be mounted to the screw mount between the handle 14 and the strainer base wall 28 to serve as a water tight seal. The handle 14 and drain member 12 can be replaced with handles and strainers of different styles.

The hollow cylindrical stem 16 has an upper end and a lower end and defines the interior compartment 22 that contains a deodorizing and/or sanitizing compound, such as a deodorizer/sanitizer tablet 23 or other solid chemical deodorizer. Optional openings 20 in the stem wall allow water to enter and exit the compartment 22, thus exposing the deodorizer/sanitizer tablet 23 to water and allowing the tablet 23 to slowly dissolve and deodorize and sanitize the disposal system.

The scraper 18 is attached to the lower end of the stem 16 by a connector 19, and extends downward from the connector 19. The scraper 18 comprises a substantially cylindrical body 38, a base 40 extending upward from the body 38 and configured to receive set screws 41, and an extension 24 centrally mounted to the underside of the body 38. The extension 24 and body 38 can be used to guide food debris into the disposal system. The scraper 18 can be made of any suitable material, but preferably is made from an elastomeric material such as rubber or plastic to prevent the scraper from scratching dishes or sinks. The scraper base 40 comprises upper and lower sections and a middle section 45 having a diameter less than the diameter of the upper and lower sections so that the set screws 41 can firmly secure the scraper 18 to the connector 19. The scraper 18 is detachable and can be replaced when worn.

The connector 19 comprises a body having female threads at its upper end and a horizontal upper wall 25 (FIG. 2) that serves as the bottom wall of the compartment 22 when the connector 19 is attached to the stem 16. The connector 19 further comprises a bottom wall 49 that mates with the scraper body 38 in the assembled device 10. An opening in the connector bottom wall 49 communicates with a space 50 within the connector 19. The space 50 is configured to accommodate the scraper base 40. The connector further comprises channels bored into the connector body for receiving the set screws 41.

Figure 2:
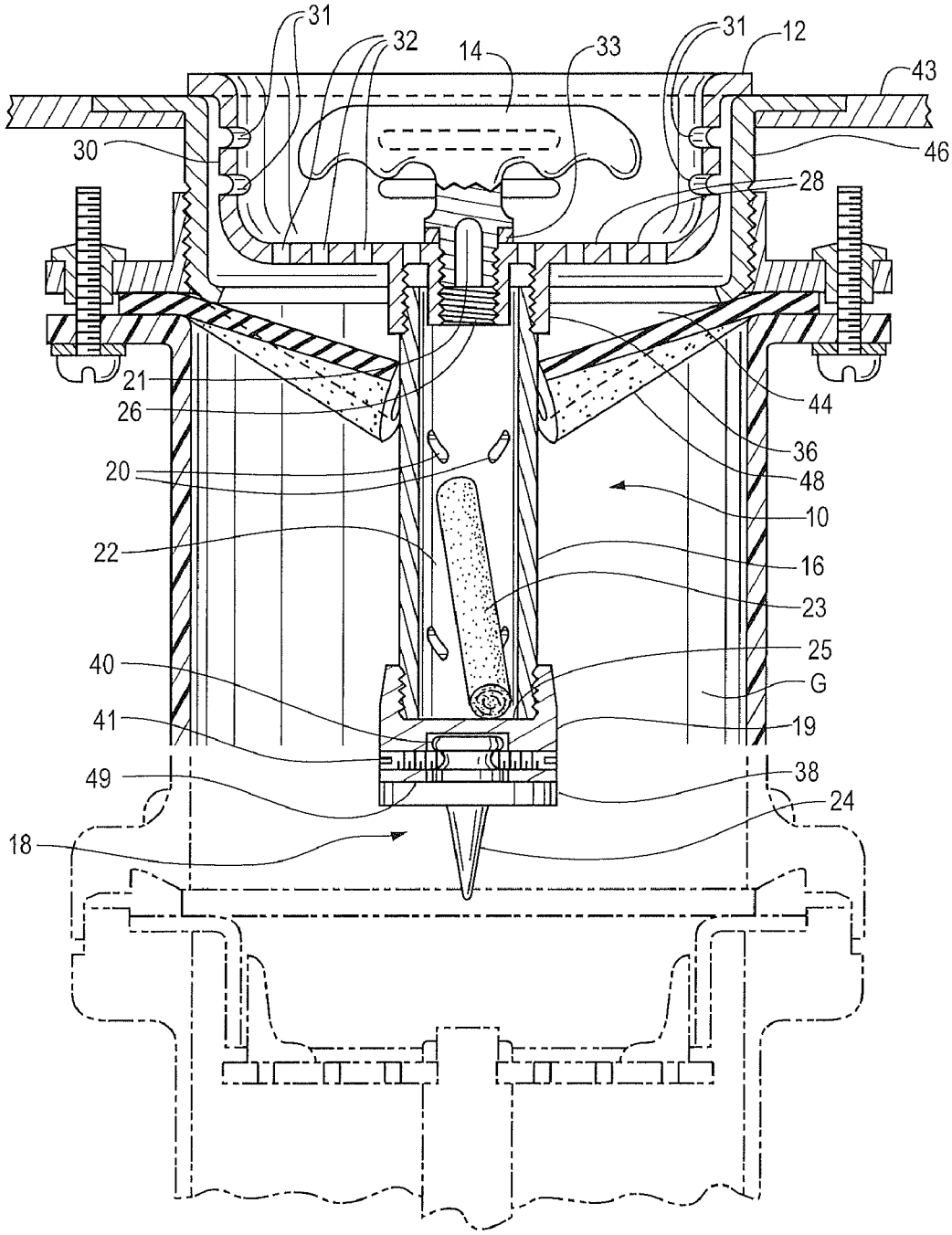
FIG. 2 is plan view of the device of FIG. 1, shown installed in a garbage disposal drain.

FIG. 2 shows the device 10 supported by a sink 43 and extending into the space within a garbage disposal unit G. When the device 10 is inserted into a garbage disposal unit G as shown in the figure, water from the sink can drain through the holes 32 in the drain member 12 and then either into the deodorizer compartment 22 or directly into the disposal unit G.

The invention works in the following manner. The scraper extension 24 can be used to collect food debris and other wastes that gather in the sink 43 and to move those materials into the area 44 within the garbage disposal drain 46. The scraper extension 24 can also be used to scrape food off dishes. Once the food debris is in the drain opening area 44, the device 10 can be used as a poker to tamp or push the food debris past the rubber safety guard 48 and into the garbage disposal unit G safely, without endangering fingers.

To use the deodorizer feature, a deodorizer/sanitizer tablet 23 or other deodorizer material may be inserted into the deodorizer compartment 22 by removing the handle 14 and exposing the central opening 21 in the strainer bottom wall 28. The tablet 23 then can be dropped into the compartment 22 and the handle 14 screwed back onto the drain member 12. Alternatively, the connector 19 can be removed from the lower end of the stem 16 and the tablet 23 inserted into the stem lower end.

It should be understood that the embodiments of the invention described above are only particular examples which serve to illustrate the principles of the invention. Modifications and alternative embodiments of the invention are contemplated which do not depart from the scope of the invention as defined by the foregoing teachings and appended claims. It is intended that the claims cover all such modifications and alternative embodiments that fall within their scope.

I claim as my invention:

1. A device for cleaning a sink and garbage disposal unit comprising a hollow tubular stem having upper and lower ends and a scraper attached to the lower end, the stem defining a deodorizer compartment that can hold a deodorizing compound;

a connector interposed between the stem and the scraper, the connector comprising a body and a horizontal upper wall that serves as a bottom wall of the deodorizer compartment;

a drain member mounted to the upper end of the stem, the drain member comprising a bottom wall and a handle attached to a bottom wall, the handle being separable from the bottom wall to expose a central hole in the bottom wall that communicates with the deodorizer compartment;

wherein the stem comprises a cylindrical wall having openings through which water can pass into and out of the deodorizer compartment.

2. A device for cleaning and deodorizing a sink and garbage disposal unit, the device comprising:

a cup-shaped strainer comprising a bottom wall and a cylindrical side wall extending upward from the bottom wall, the bottom wall including water drainage holes, some of which communicate with a deodorizer compartment located within a stem, the strainer further comprising a screw mount base extending downward from the strainer bottom wall and attachable to the stem by means of a threaded connection;

a handle removably attached to the strainer over a central hole located in the bottom wall of the strainer, the central hole communicating with the deodorizer compartment of the stem;

the stem extending downward from and attached to the strainer, the stem being hollow and having an upper end and a lower end and a cylindrical wall that substantially defines the deodorizer compartment, the deodorizer compartment being configured to hold a deodorizer/sanitizer tablet or other solid chemical deodorizer; and a replaceable scraper connected to the lower end of the stem, the scraper comprising a body and an extension mounted to an underside of the body wherein the scraper is attached to the lower end of the stem by a connector, the scraper extending downward from the connector.

3. The device of claim 2 wherein:

the scraper further comprises a base extending upward from the scraper body, the base comprising upper and lower sections and a middle section having a diameter less than the diameter of the upper and lower sections to accommodate one or more set screws; and wherein the connector further comprises a body having a bottom wall that mates with the scraper body, an opening in the connector bottom wall communicating with a space within the connector body, the space being configured to accommodate the scraper base, and channels bored into the connector body for receiving the set screws.

4. The device of claim 3 wherein the stem cylindrical wall includes openings to allow water to enter and exit the deodorizer compartment.

* * * * *